US008082125B2

(12) United States Patent
Eichner

(10) Patent No.: US 8,082,125 B2
(45) Date of Patent: Dec. 20, 2011

(54) APPARATUS AND METHOD FOR THE CONDITION-DEPENDENT MAINTENANCE OF HYDROSTATIC DISPLACEMENT UNITS

(75) Inventor: Wilfried Eichner, Neubulach (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 244 days.

(21) Appl. No.: 11/921,278

(22) PCT Filed: Dec. 12, 2006

(86) PCT No.: PCT/EP2006/011950

§ 371 (c)(1),
(2), (4) Date: Nov. 29, 2007

(87) PCT Pub. No.: WO2007/068447

PCT Pub. Date: Jun. 21, 2007

(65) Prior Publication Data

US 2009/0229455 A1 Sep. 17, 2009

(30) Foreign Application Priority Data

Dec. 13, 2005 (DE) ..... 10 2005 059 566

(51) Int. Cl.
*G06F 11/30* (2006.01)

(52) U.S. Cl. ..... 702/184

(58) Field of Classification Search ..... 702/184
See application file for complete search history.

(56) References Cited

U.S. PATENT DOCUMENTS

| | | | | |
|---|---|---|---|---|
| 7,043,975 | B2 * | 5/2006 | Du | 73/168 |
| 2004/0079158 | A1 | 4/2004 | Mercer | |
| 2004/0165185 | A1 * | 8/2004 | Reintjes et al. | 356/335 |
| 2004/0167738 | A1 * | 8/2004 | Miller | 702/114 |
| 2005/0180868 | A1 * | 8/2005 | Miller | 417/437 |
| 2005/0262838 | A1 | 12/2005 | Kageyama et al. | |

FOREIGN PATENT DOCUMENTS

| | | |
|---|---|---|
| DE | 195 46 299 | 7/1996 |
| DE | 199 51 961 | 5/2001 |
| DE | 100 18 866 | 10/2001 |
| DE | 103 22 220 | 10/2004 |
| DE | 103 34 817 | 3/2005 |
| GB | 2 190 198 | 11/1987 |

* cited by examiner

*Primary Examiner* — Aditya Bhat
(74) *Attorney, Agent, or Firm* — Scully, Scott, Murphy & Presser, P.C.

(57) ABSTRACT

The invention relates to an apparatus (1) and a method for the condition-dependent maintenance of hydrostatic displacement units (2), in particular axial piston machines (3) operated as pumps or motors. Mounted on the hydrostatic displacement unit (2) are acceleration sensors (4) and/or contamination level sensors (5) which capture vibration data and/or contamination data of the hydrostatic displacement unit (2) and are connected to an evaluation unit (6) which temporarily stores the vibration data and/or contamination data. A communication unit (7) connected to the evaluation unit (6) retransmits said data.

12 Claims, 2 Drawing Sheets

APPARATUS AND METHOD FOR THE CONDITION-DEPENDENT MAINTENANCE OF HYDROSTATIC DISPLACEMENT UNITS

BACKGROUND

The invention relates to an apparatus and a method for the condition-dependent maintenance of hydrostatic displacement units.

When hydraulic plants cease operating as a result of maintenance work or a malfunction, cost-intensive down-time during which replacement parts must be exchanged is the result. Furthermore, down-time can cause contamination of the whole hydraulic circuit, so that the entire plant must be cleaned before being put back into service, and the hydraulic oil, together with system components such as filter elements, must be exchanged. If hydraulic plants are not in operation, for example, in a production line, this results not only in reduced productivity but also in very high costs for shutting down and restarting the hydraulic plant.

According to the prior art, in order to reduce failures a hydraulic plant should be so equipped that it can also be controlled over relatively long distances.

For example, a pump unit comprising a pump and an electric motor which drives the pump is known from DE 100 18 866 A1. A digital motor control system is provided for the electric motor, which control system is connected via a bus to a digital communication unit which has an interface based on Internet protocols, so that the pump unit is ultimately controllable via a digital network, an intranet or the Internet.

A disadvantage of the prior art emerging from DE 100 18 866 A1 is that the pump unit is not controlled directly, but via the motor control system which is remotely operable via the digital communication unit. The pump unit itself has at least one sensor, such as a pressure sensor, a differential pressure sensor or a temperature sensor, the output signal of which can be interrogated via the communication unit. However, data relating directly to operation of the pump or the pump unit, such as surface vibration of the housing and the contamination level of the hydraulic fluid, is not detected in the pump unit according to the document DE 100 18 866 A1. This gives rise to the disadvantage that the data acquired and transmitted for determining service intervals is insufficient, because relevant data such as the average amplitude of housing surface vibration, or the abraded material contained in the hydraulic fluid, is not acquired in the pump unit according to the document DE 100 18 866 A1.

SUMMARY

It is the object of the present invention to eliminate the disadvantages of the prior art and to provide an apparatus and a method for detecting phenomena relating to failure, for determining service intervals and for analysing damage processes in hydrodynamically operated machines.

One aspect of the present invention relates to an apparatus and a method for the condition-dependent maintenance of hydrostatic displacement units, in particular axial piston machines operated as pumps or motors. For this purpose acceleration sensors and/or contamination level sensors which capture vibration data and contamination data of the hydrostatic displacement unit are mounted on the hydrostatic displacement unit. The sensors are connected to an evaluation unit which temporarily stores the vibration data and contamination data, a communication unit which retransmits this data and is connected to the evaluation unit being provided on the hydrostatic displacement unit.

The measures stated in the dependent claims relate to advantageous developments of the invention.

In particular, it is advantageous that a first acceleration sensor is provided in a bearing region of the hydrostatic displacement unit, so that shaking at the housing surface in the region of the bearing can be detected using measuring methods.

It is further advantageous that a second acceleration sensor is provided in a reversing zone of the hydrostatic displacement unit, so that cavitation occurring at the change-over from the high-pressure zone to the low-pressure zone is reliably detected.

It is further advantageous that a first contamination level sensor, which may be a particle sensor, is provided in the hydraulic circuit, so that abraded material can already be detected in the hydraulic fluid being circulated. A second contamination level sensor located in the leakage oil line is advantageous if the first contamination level sensor fails. It is thereby ensured that, despite failure of a contamination level sensor, abraded material contained in the hydraulic fluid can continue to be detected.

In the apparatus according to the invention an evaluation unit is advantageously provided which can also be interrogated remotely via an intranet or an Internet connection using a communication unit connected thereto. A Web server is advantageously installed in the communication unit, allowing convenient and user-friendly access to the stored data, in particular the contamination data, and enabling evaluation of surface vibration.

In this case it is advantageous that the data evaluated with respect to surface vibration and contamination level characterises the state of the hydrostatic displacement unit and of the hydraulic fluid, and therefore indicates a maintenance operation which becomes necessary before its due date, and in particular before an occurrence of damage, and can be interrogated from outside via the Web server, so that any necessary down-time can be suitably reconciled with the production process, since the down-time can be made known with a degree of advance notice.

It is further advantageous that at least two acceleration sensors are mounted on the housing of the hydrostatic displacement unit, so that housing surface vibration can be detected in two directions.

Because the communication element has a Web server, communication with the Web server can be conducted, and therefore data relating to the hydrostatic displacement unit can be interrogated, from any Internet-enabled PC.

Furthermore, all the data stored in the evaluation unit and present in the Web server can be visualised and further processed via the browser. In addition, it is advantageous that the Web server can also be configured via the browser of the external, Internet-enabled PC.

BRIEF DESCRIPTION OF THE DRAWINGS

A preferred embodiment of the inventive apparatus for the condition-dependent maintenance of hydrostatic displacement units is represented in the drawings and is explained in more detail in the following description. In the drawings.

DETAILED DESCRIPTION OF EXEMPLARY EMBODIMENTS

Figure 1:
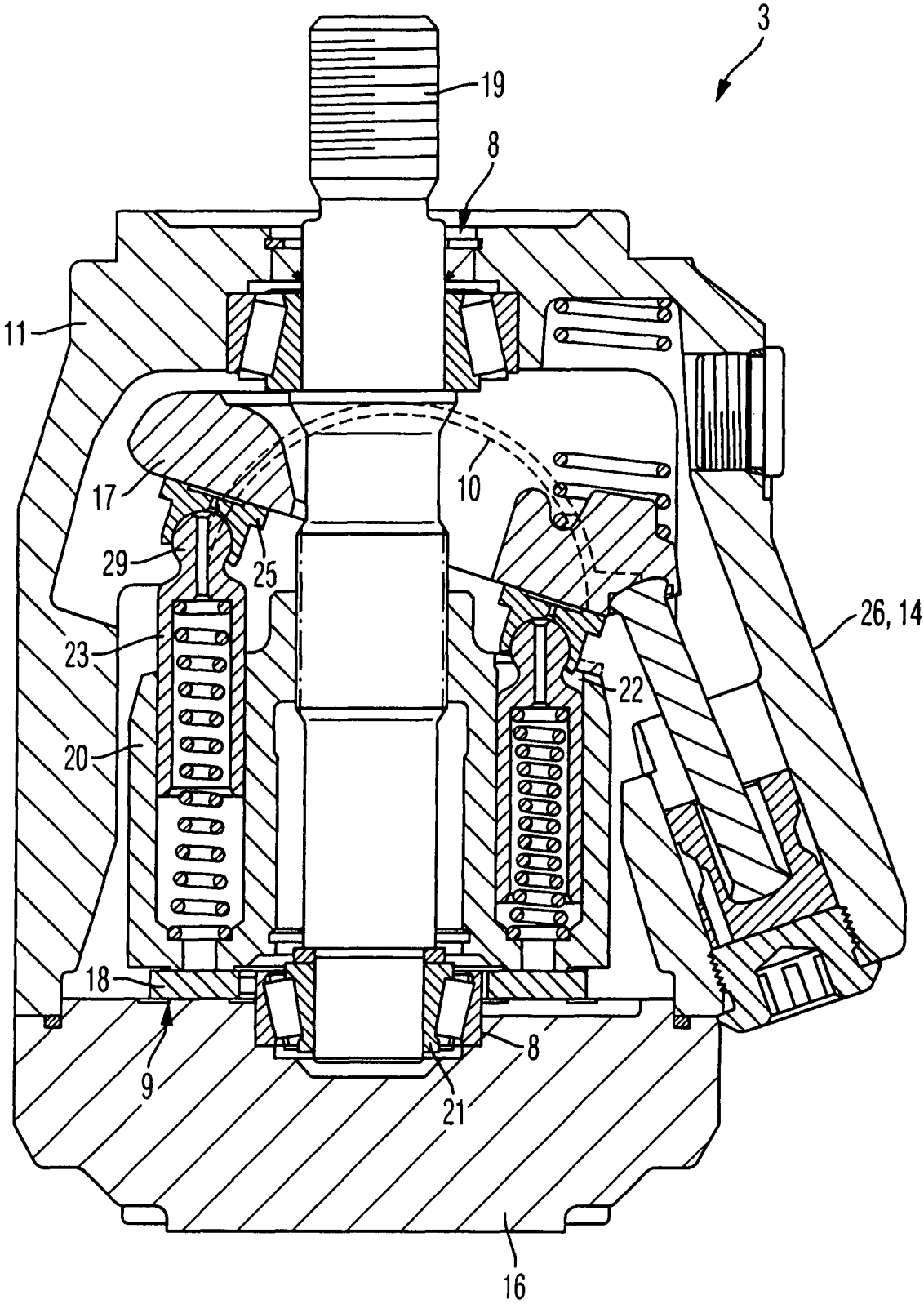
FIG. 1 is a sectional representation of a conventional axial piston machine for clarification of the parameters measured.

The axial piston machine 3 shown in FIG. 1 is of the swash plate type with adjustable displacement volume and a single flow direction, and comprises in known fashion as its essential components a substantially hollow-cylindrical housing 11 with an open front end (lower end in FIG. 1), a housing cover 16 fixed to the housing 11 and closing the open end thereof, a swash plate 17, also referred to as an eccentric disc, a control plate 18, a shaft 19 and a cylinder drum 20. A swivel angle of the swash plate 17 is determined by means of a suitable sensor (not shown in this illustration) and is transmitted to an evaluation unit 6 of the inventive apparatus 1 for the condition-dependent maintenance of hydrostatic displacement units 2.

The shaft 19 is mounted rotatably in the housing 11 and passes centrally through the cylinder drum 20, a first acceleration sensor 4 being provided on the housing 11 of the axial piston machine 3 in a bearing region 8 of the hydrostatic displacement unit 2. The cylinder drum 20 is connected non-rotatably but axially movably to the shaft 19, and therefore can be removed therefrom. The shaft 19 is mounted in a rolling bearing 21 on each side of the cylinder drum 20. A rotational speed sensor (not visible in this illustration) mounted on the shaft 19 determines the instantaneous rotational speed of the shaft 19 and transmits said speed to the evaluation unit 6.

A plurality of cylinder bores 22 are distributed circumferentially in the cylinder drum 20. A piston 23 is inserted axially movably in each cylinder bore 22. Each of the pistons 23 has a spherical head 24 at the end oriented away from the housing cover 16, which head 24 cooperates with a corresponding recess in a slide block 25 to form an articulated joint. The piston 23 bears against the swash plate 17 by means of the slide block 25. Upon a rotation of the cylinder drum 20, therefore, the pistons 23 execute a stroke movement in the cylinder bores 22. The length of the stroke is predetermined by the position of the swash plate 17, the position of the swash plate 17 being adjustable by a positioning device 26 in the present embodiment.

The control openings of the control plate 18 (not visible in the section represented in FIG. 1) are in permanent communication, on their side facing away from the cylinder drum 20, with at least one high-pressure or low-pressure connection (not shown in this Figure). This region of the axial piston pump 3 is also referred to as the reversing zone 9. According to the invention, a second accelerometer 4 is provided in the reversing zone 9 of the hydrostatic displacement unit 2.

The cylinder bores 22 are open towards the end face of the cylinder drum 20 via openings. Upon a rotation of the cylinder drum 20 the openings slide across a sealing portion of the control plate 18 while being connected alternately to the control openings (not visible) during one revolution.

The operation of the above-described axial piston machine 3 is generally known and is limited to essentials in the following description of an application as a pump.

The axial piston machine 3 is provided for operation in a hydraulic circuit 10, for example, with oil as the hydraulic fluid. The hydraulic fluid is circulated in the hydraulic circuit 10 of a hydrostatic displacement unit 2. In the inventive apparatus 1 for condition-dependent maintenance, a first contamination level sensor 5, which may be a particle sensor, is provided inside the hydraulic circuit 10, in order to detect the concentration of the abraded material contained therein. In addition, a second contamination level sensor 5 is provided inside a leakage oil line, said leakage oil line not being shown in the present FIG. 1 of the axial piston machine.

The cylinder drum 20, together with the pistons 23, is set in rotation via the shaft 19. If the swash plate 17 is swivelled to an oblique position with respect to the cylinder drum 20 through actuation of the positioning device 26, all the pistons 23 execute stroke movements. During a rotation of the cylinder drum through 360°, each piston 23 executes a suction stroke and a compression stroke, corresponding oil flows being generated which are supplied and discharged via the openings, the control openings (not visible) of the control plate 18 and the high-pressure or low-pressure connection (not shown).

Figure 2:
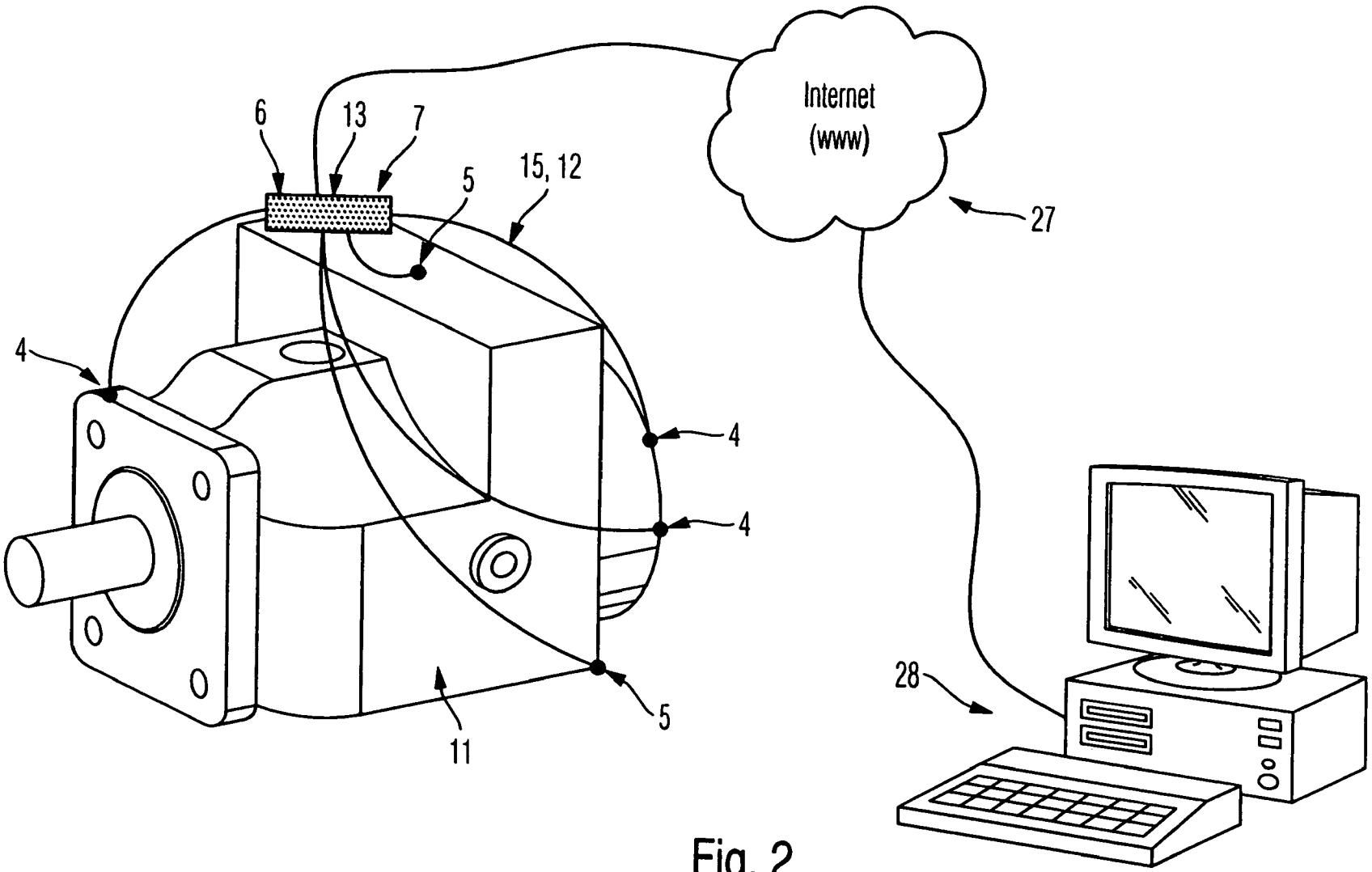
FIG. 2 is a schematic representation of the inventive apparatus comprising an axial piston machine which is connected to an external PC via a Web server.

FIG. 2 is a schematic representation of an inventive apparatus 1 for the condition-dependent maintenance of hydrostatic displacement units 2, in particular of axial piston machines 3 operated as pumps or motors. The acceleration sensors 4 and/or contamination level sensors 5, which capture vibration data and/or contamination data of the hydrostatic displacement unit 2, are mounted thereon. The sensors are connected to an evaluation unit 6 which evaluates and temporarily stores the vibration and/or contamination data, a communication unit 7 being provided which is connected to the evaluation unit 6 and retransmits the data.

The communication unit 7 connected to the evaluation unit 6 is preferably integrated in an onboard electronic unit 12 or screwed thereto. Alternatively, it may be fixed to the housing 11 of the hydrostatic displacement unit 2 or may be integrated in the evaluation unit 6 itself.

The communication unit 7 provided according to the invention is a digital communication unit in which there is installed a Web server 13 which makes available the evaluated data of the sensors mounted on the hydrostatic displacement unit 2, so that said data can be retransmitted, either automatically or upon request, to an external PC 28 connected to the Internet 27 or to an intranet, said retransmission being effected via an intranet or Internet connection. For this purpose the Web server 13 of the communication unit 7 is wire-connected by means of a LAN connection, or wirelessly connected by means of a GSM modem or WLAN, to the Internet 27. The evaluation unit 6 is connected to the communication unit 7 by means of a data bus or by means of a wireless connection, such as an infrared or RFID connection. Transmission via the Ethernet is also possible.

In the inventive method for the condition-dependent maintenance of hydrostatic displacement units 2, in particular axial piston machines 3 operated as pumps or motors, acceleration sensors 4 and/or contamination level sensors 5, which capture vibration data and/or contamination data of the hydrostatic displacement unit 2, are mounted thereon. This data is temporarily stored in an evaluation unit 6. A communication unit 7, which is connected to the evaluation unit 6 and retransmits the vibration data and/or contamination data captured, is mounted on the hydrostatic displacement unit 2. In a further exemplary embodiment of the present invention the communication unit 7 is integrated in a mechanical or electrical control device 14, 15.

At least one first acceleration sensor 4 is mounted in a bearing region 8 of the hydrostatic displacement unit 2 and a second acceleration sensor 4 is mounted in a reversing zone 9 of the hydrostatic displacement unit.

In addition to the acceleration sensors 4, a first contamination level sensor 5 is positioned in a hydraulic circuit 10 of the hydrostatic displacement unit 2, and a second contamination level sensor 5 is positioned inside a leakage oil line.

The communication unit 7 connected to the evaluation unit 6 is fixed to a housing 11 of the hydrostatic displacement unit 2 or is screwed to an onboard electronic unit 12 of the hydrostatic displacement unit 2.

The invention is not restricted to axial piston machines actuated by swash plate and is also applicable, for example, to oblique-axis axial piston machines, or further hydrostatic displacement units with closed or open hydraulic circuits.

The invention claimed is:

1. An apparatus for the condition-dependent maintenance of hydrostatic displacement units of axial piston machines operated as pumps or motors, said apparatus comprising:

at least one first acceleration sensor and at least one contamination level sensor which capture vibration data and contamination data of a hydrostatic displacement unit and which are connected to an evaluation unit which evaluates the vibration data and the contamination data, said at least one contamination level sensor being mounted on the hydrostatic displacement unit, wherein said at least one first acceleration sensor is provided on a pump or motor housing surface in a bearing region of the hydrostatic displacement unit for detection of shaking or vibrations deleterious to the hydrostatic displacement unit, a communication unit, which is connected to the evaluation unit and retransmits said data for further processing, said retransmission being effected via an intranet or Internet connection, the communication unit being integrated in an onboard electronic unit of the hydrostatic displacement unit, and a Web server being installed in the communication unit.

2. The apparatus according to claim 1, wherein at least one second acceleration sensor is provided located in a reversing zone of the hydrostatic displacement unit for detecting any cavitation occurring in a flow of hydraulic fluid circuit at a change-over location from a high-pressure zone to a low-pressure zone.

3. The apparatus according to claim 1, wherein said at least one first contamination level sensor is provided in a hydraulic circuit of the hydrostatic displacement unit.

4. The apparatus according to claim 1, wherein a second contamination level sensor is provided inside a leakage oil line.

5. The apparatus according to claim 1, wherein said at least one first contamination level sensor is a particle sensor.

6. The apparatus according to claim 1, wherein the communication unit which is connected to the evaluation unit is arranged on a housing of the hydrostatic displacement unit.

7. The apparatus according to claim 1, wherein the communication unit is arranged on an onboard electronic unit of the hydrostatic displacement unit.

8. The apparatus according to claim 1, wherein the communication unit is integrated in the evaluation unit.

9. The apparatus according to claim 1, wherein the communication unit is a digital communication unit.

10. The apparatus according to claim 1, wherein the communication unit is connected to the evaluation unit by a data bus.

11. The apparatus according to claim 1, wherein the communication unit is connected to the evaluation unit by a wireless connection.

12. A method for the condition-dependent maintenance of hydrostatic displacement units of axial piston machines operated as pumps or motors, at least one acceleration sensor and at least one contamination level sensor being mounted on a hydrostatic displacement unit, said method comprising:

capturing vibration data and contamination data of the hydrostatic displacement unit, and evaluating said captured data in an evaluation unit, wherein a communication unit is mounted on the hydrostatic displacement unit, which is connected to the evaluation unit and which retransmits the captured and evaluated vibration data and contamination data , said retransmission being effected via an intranet or Internet connection, the communication unit being integrated in an onboard electronic unit of the hydrostatic displacement unit, and a Web server is installed in the communication unit.

* * * * *